US005890928A

United States Patent [19]

Fuchs et al.

[11] Patent Number: 5,890,928

[45] Date of Patent: Apr. 6, 1999

[54] PLUG ASSEMBLY FOR SOLENOID VALVE

[75] Inventors: Helmut Fuchs, Halver; Lothar Fuhrmeister, Schalksmühle, both of Germany

[73] Assignee: Firma Karl Lumberg GmbH & Co., Schalksmuhle, Germany

[21] Appl. No.: 962,372

[22] Filed: Oct. 31, 1997

[30] Foreign Application Priority Data

Nov. 11, 1996 [DE] Germany ..... 196 46 293.2

[51] Int. Cl.[6] ..... H01R 13/40

[52] U.S. Cl. ..... 439/588; 439/278

[58] Field of Search ..... 439/278, 588, 439/606, 736, 682

[56] References Cited

U.S. PATENT DOCUMENTS

| | | | |
|---|---|---|---|
| 2,127,544 | 8/1938 | Holtz | 439/279 |
| 2,458,153 | 1/1949 | Festge | 439/588 |
| 2,502,634 | 4/1950 | Smith | 439/682 |
| 3,120,987 | 2/1964 | Degnan | 439/588 |

FOREIGN PATENT DOCUMENTS

| | | |
|---|---|---|
| 0700130 | 3/1996 | European Pat. Off. . |
| 35 07 696 | 4/1986 | Germany . |

*Primary Examiner*—Steven L. Stephan
*Assistant Examiner*—T C Patel
*Attorney, Agent, or Firm*—Herbert Dubno; Andrew Wilford

[57] ABSTRACT

An electrical connector assembly has a rigid body having an outwardly directed face and formed with a plurality of pockets opening at the face, respective electrical contacts fixed in the pockets of the body, and a cover formed of a flexible elastomeric plastic completely surrounding the body except at the pockets. This cover is formed unitarily with an annular skirt projecting outward past the face and with a web bridging the skirt except at the pockets and lying against the face of the body.

9 Claims, 1 Drawing Sheet

PLUG ASSEMBLY FOR SOLENOID VALVE

FIELD OF THE INVENTION

The present invention relates to a plug assembly. More particularly this invention concerns an electrical multiconductor plug used to connect to a solenoid valve or the like.

BACKGROUND OF THE INVENTION

Many electrical elements such as solenoid valves are provided with a plurality of outwardly projecting connector prongs to which a connector is attached to supply power to the element, receive sensor data from it, and/or communicate electrically with it. In German patent 3,507,696 filed 5 Mar. 1985 by F. Hafner such a system is disclosed having a rigid body provided with a plurality of connectors and here also incorporating some circuitry in the form of a printed circuit, electronic circuit elements, and a pilot lamp. A multiconductor cable extends laterally from the body which is typically a mainly plastic block. In order to protect the electrical connections and circuit elements from the elements, the body is fitted in a cap of a somewhat softer synthetic resin that has a seal skirt projecting from the face at which the connectors are exposed. For best fit this cup-shaped cap is formed directly around the body, for instance of a thermoplastic polyurethane elastomer.

This connector can therefore be fitted over the upstanding connector prongs of the solenoid valve, with the skirt engaging down around the connection region to seal it. The result when everything fits together perfectly is a good seal and a well protected connection. Due to the difference in materials between the body and the cap, however, these two parts are not physically bond together and can separate from each other. Thus with time, in particular as the plastic parts age, the skirt pulls away from the surface, leaving a crack into which water and foreign matter can enter to foul the contacts.

OBJECTS OF THE INVENTION

It is therefore an object of the present invention to provide an improved plug assembly.

Another object is the provision of such an improved plug assembly which overcomes the above-given disadvantages, that is which forms a tight seal that has a long service life.

SUMMARY OF THE INVENTION

An electrical connector assembly has according to the invention a rigid body having an outwardly directed face and formed with a plurality of pockets opening at the face, respective electrical contacts fixed in the pockets of the body, and a cover formed of a flexible elastomeric plastic completely surrounding the body except at the pockets. This cover is formed unitarily with an annular skirt projecting outward past the face and with a web bridging the skirt except at the pockets and lying against the face of the body.

Thus with this system separation of the side panels of the cover from the outer side surfaces of the body is impeded by the web that extends across the face. This web is put in tension whenever any force tends to outwardly displace the skirt, thereby effectively preventing outward movement.

The web according to the invention covers substantially all of the face except at the pockets, which include the locations provided with contacts and a hole for an attachment screw. In addition the body has sides formed with grooves and the plastic of the cover fills the grooves. These grooves are undercut, typically dovetail shaped. In addition they extend generally perpendicular to the face.

The body in accordance with the invention is generally parallepipedal. Each of the contacts is a fork imbedded in the body which itself is formed of polyurethane.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
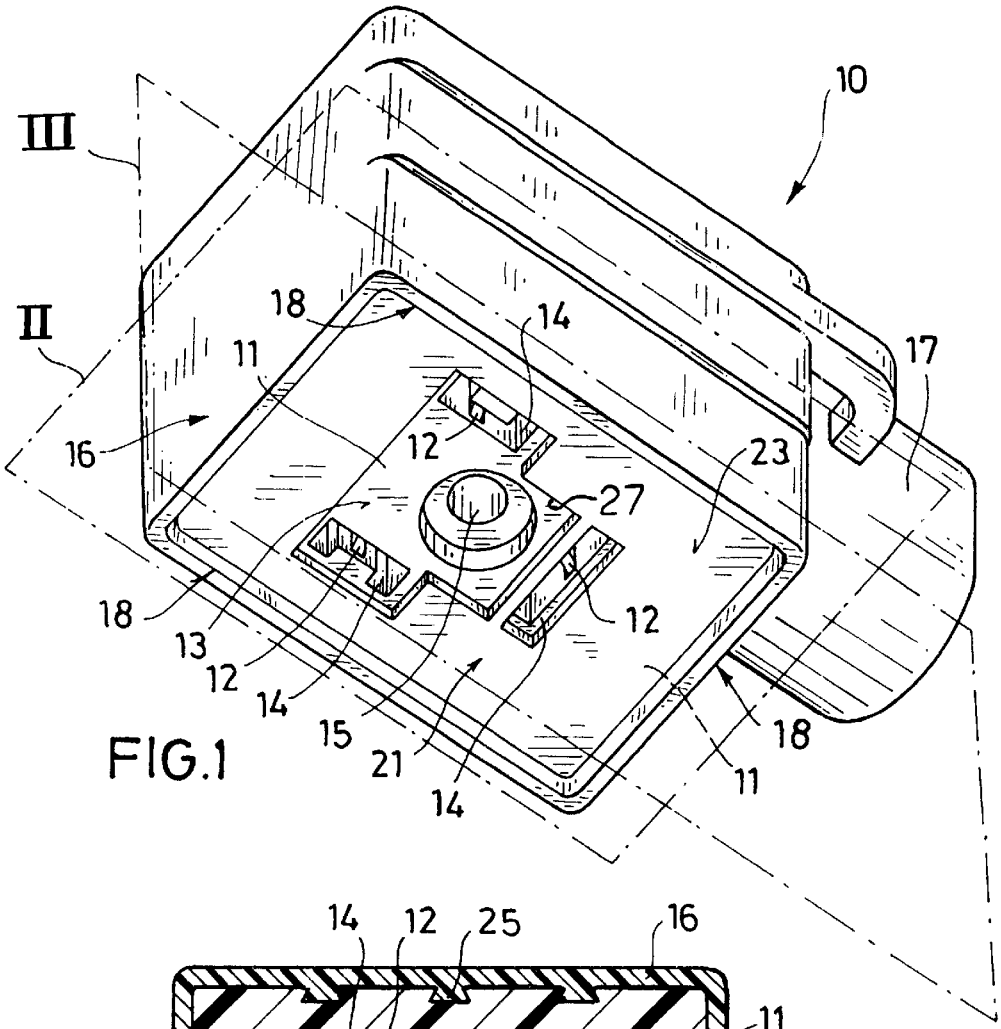
FIG. 1 is a perspective view of the connector assembly according to the invention.
Figure 2:
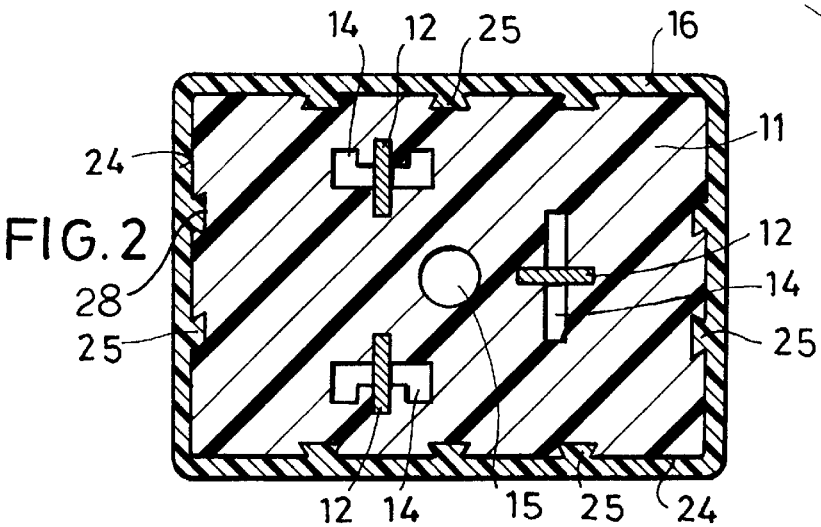
FIGS. 2 and 3 are sections taken along respective planes II and III of FIG. 1.
Figure 3:
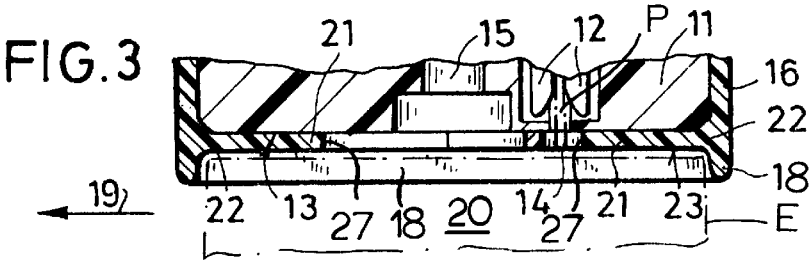

As seen in FIGS. 1 through 3 a plug or connector 10 has a rigid plastic body 11 having a planar lower face 13 at which open a plurality of pockets or apertures 14 each provided with a respective metallic contact fork 12 so that a prong P (dashed lines, FIG. 3) inserted into one of the openings 14 makes good electrical contact with the respective connector 12. In addition the body 11, which can incorporate circuit elements not illustrated here, is formed with a central throughgoing hole 15 opening at the face 13 and normally accommodating a screw which has a head that bears on the face of the body 11 opposite the face 13 and a threaded shank engaged in an element E (dashed lines, FIG. 3) to which the connector 10 is fitted.

According to the invention an elastomeric cover 16 is formed around the parallepipedal body 11 of a relatively soft elastomer, here polyurethane. The cover 16 is molded in situ on the body 11 and has a generally uniform wall thickness, with a tubular collar 17 extending from one side to hold an unillustrated multiconductor cable connected directly or indirectly to the contacts 12. This body 16 forms an annular skirt 18 that projects outward past the face 13 and according to the invention is also formed with a web 21 that extends across and lies against the face 13 from an edge region 22 of the cover 16. The web 21 is formed with cutouts 27 to match the apertures 14 and 15 as shown in FIG. 1 but otherwise extends from side to side of the skirt 16 so that if same is pushed out as shown by arrow 19, it will not separate from the body 1.

Furthermore in accordance with the invention sides 24 of the body 11 are formed with dovetail-section grooves 28 that are filled with the material of the cover 1 as dovetail-section ridges 25 that further secure the cover 16 to these sides 24. When installed, a face 23 of the web 21 engages the element E from which the connector prongs P extend into the contacts 12. Since the softer material of the cover 16 extends virtually all around the body 11, except over the apertures 14 and 15, it will remain a tight fit thereon.

We claim:

1. An electrical connector assembly comprising:

a rigid body having an outwardly directed face and sides and formed with a plurality of pockets opening at the face;

respective electrical contacts fixed in the pockets of the body; and a cover formed of a flexible elastomeric plastic completely surrounding the body in tight contact with the sides and face thereof except at the pockets and formed unitarily with an annular skirt projecting outward past the face, and a web bridging the skirt except at the pockets and lying against the face of the body.

2. The connector assembly defined in claim 1 wherein the web covers substantially all of the face except at the pockets.

3. The connector assembly defined in claim 1 wherein the sides are formed with grooves, the plastic of the cover filling the grooves.

4. The connector assembly defined in claim 3 wherein the grooves are undercut.

5. The connector assembly defined in claim 3 wherein the grooves extend generally perpendicular to the face.

6. The connector assembly defined in claim 1 wherein the body is generally parallepipedal.

7. The connector assembly defined in claim 1 wherein each of the contacts is a fork imbedded in the body.

8. The connector assembly defined in claim 1 wherein the plastic is polyurethane.

9. The connector assembly defined in claim 1 wherein the cover is molded around the body.

* * * * *